US009408464B2

(12) United States Patent
Keeling et al.

(10) Patent No.: US 9,408,464 B2
(45) Date of Patent: Aug. 9, 2016

(54) ASSEMBLY KIT AND DOOR ASSEMBLY FOR APPLIANCE

(71) Applicant: General Electric Company, Schenectady, NY (US)

(72) Inventors: Stewart Christopher Keeling, Louisville, KY (US); Russell James Fallon, Louisville, KY (US); Stuart McVey Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 36 days.

(21) Appl. No.: 14/295,872

(22) Filed: Jun. 4, 2014

(65) Prior Publication Data

US 2015/0351541 A1 Dec. 10, 2015

(51) Int. Cl.

| | |
|---|---|
| ***A47B 95/00*** | (2006.01) |
| ***A47L 15/42*** | (2006.01) |
| ***E06B 5/00*** | (2006.01) |
| ***F25D 23/10*** | (2006.01) |
| *A47B 96/20* | (2006.01) |
| *A47B 77/08* | (2006.01) |

(52) U.S. Cl.

CPC ..... *A47B 95/00* (2013.01); *A47L 15/4265* (2013.01); *E06B 5/006* (2013.01); *F25D 23/10* (2013.01); *A47B 77/08* (2013.01); *A47B 2096/208* (2013.01); *E05Y 2900/31* (2013.01); *F25D 2400/18* (2013.01)

(58) Field of Classification Search

CPC . A47B 96/205; A47B 95/00; A47B 2096/208
USPC ..... 248/229.1, 229.15, 228.6, 231.71; 312/405, 405.1, 204, 109, 321.5
See application file for complete search history.

(56) References Cited

U.S. PATENT DOCUMENTS

| | | | | |
|---|---|---|---|---|
| 6,536,856 | B2 | 3/2003 | Pelizzari et al. | |
| 8,382,219 | B2 | 2/2013 | Hottmann et al. | |
| 8,388,074 | B1 * | 3/2013 | Donberger | A47B 77/08 312/204 |
| 2004/0222725 | A1 * | 11/2004 | Park | A47B 77/08 312/405 |
| 2010/0283359 | A1 * | 11/2010 | Hottmann | A47B 88/0051 312/204 |
| 2012/0286632 | A1 * | 11/2012 | Wilson | F25D 23/10 312/204 |
| 2013/0134851 | A1 | 5/2013 | Hottmann et al. | |

FOREIGN PATENT DOCUMENTS

| | | |
|---|---|---|
| DE | 32 18 837 | * 11/1983 |
| DE | 297 00 349 | * 4/1997 |
| EP | 0718459 | 6/1996 |
| WO | WO 2013/182428 | * 12/2013 |

* cited by examiner

*Primary Examiner* — Gregory Strimbu
(74) *Attorney, Agent, or Firm* — Dority & Manning, P.A.

(57) ABSTRACT

An assembly kit includes a first bracket connectable to an appliance door, and a second bracket connectable to a decorative door panel. The assembly kit further includes a first spacer positionable between the first bracket and the second bracket, the first spacer movable to adjust a gap between the first bracket and the second bracket along a first axis. The assembly kit further includes a second spacer positionable between the first bracket and the second bracket, the second spacer movable to adjust a gap between the first bracket and the second bracket along a second axis different from the first axis. The assembly kit further includes a fastener operable to couple the first bracket and the second bracket together.

13 Claims, 6 Drawing Sheets

ASSEMBLY KIT AND DOOR ASSEMBLY FOR APPLIANCE

FIELD OF THE INVENTION

The present disclosure relates generally to appliance doors, and more particularly to assembly kits for coupling appliance doors and decorative door panels together as well as the resulting door assemblies.

BACKGROUND OF THE INVENTION

Traditional appliance doors have a factory-installed exterior cover that is made from high grade sheet steel, such as stainless steel, or from corrosion-protected sheet steel. More recently, appliances have been integrated into kitchen furniture or installed adjacent thereto. In many cases, it is desirable for the appearance of the appliances to match, for example, the kitchen cabinets or other furniture. Accordingly, decorative door panels can be coupled to the doors.

Typically, a decorative door panel is subsequently joined to the door of an appliance after the appliance is installed in its intended place of use. An objective during installation of such a decorative door panel is to achieve flush and level alignment with the kitchen furniture adjacent thereto. With integrated appliances, the length and/or width of the decorative door panel is generally a few centimeters longer and/or wider than the appliance door since the decorative door panel must cover both the appliance door as well as the opening for the space in which the appliance is installed.

Current mechanisms for decorative door panel adjustment require a great deal of time and effort. For instance, existing mechanisms typically utilize turnscrew posts to provide vertical lift to decorative door panels. Such mechanisms are difficult to access, not easily operated, and fail to achieve precise decorative panel adjustment.

Accordingly, an assembly kit that allows for more efficient and precise decorative door panel adjustment would be desirable. Additionally, a door assembly incorporating such an assembly kit would be particularly useful.

BRIEF DESCRIPTION OF THE INVENTION

Aspects and advantages of the disclosure will be set forth in part in the following description, or may be obvious from the description, or may be learned through practice of the disclosure.

In accordance with one embodiment of the present disclosure, an assembly kit for coupling an appliance door and a decorative door panel together is provided. The assembly kit includes a first bracket connectable to the appliance door, and a second bracket connectable to the decorative door panel. The assembly kit further includes a first spacer positionable between the first bracket and the second bracket, the first spacer movable to adjust a gap between the first bracket and the second bracket along a first axis. The assembly kit further includes a second spacer positionable between the first bracket and the second bracket, the second spacer movable to adjust a gap between the first bracket and the second bracket along a second axis different from the first axis. The assembly kit further includes a fastener operable to couple the first bracket and the second bracket together.

In accordance with another embodiment of the present disclosure, a door assembly for an appliance is provided. The door assembly includes an appliance door, the appliance door comprising an inner surface, and outer surface, and an edge surface extending between the inner surface and the outer surface. The door assembly further includes a decorative door panel, the decorative door panel comprising an inner surface, and outer surface, and an edge surface extending between the inner surface and the outer surface. The door assembly further includes an assembly kit coupling the appliance door and the decorative door panel together, the appliance door including a first bracket connected to the appliance door and a second bracket connected to the decorative door panel. The assembly kit further includes a first spacer positioned between the first bracket and the second bracket, the first spacer movable to adjust a gap between the first bracket and the second bracket along a first axis. The assembly kit further includes a second spacer positioned between the first bracket and the second bracket, the second spacer movable to adjust a gap between the first bracket and the second bracket along a second axis different from the first axis. The assembly kit further includes a fastener coupling the first bracket and the second bracket together.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure, including the best mode thereof, directed to one of ordinary skill in the art, is set forth in the specification, which makes reference to the appended figures, in which.

DETAILED DESCRIPTION OF THE INVENTION

Figure 1:
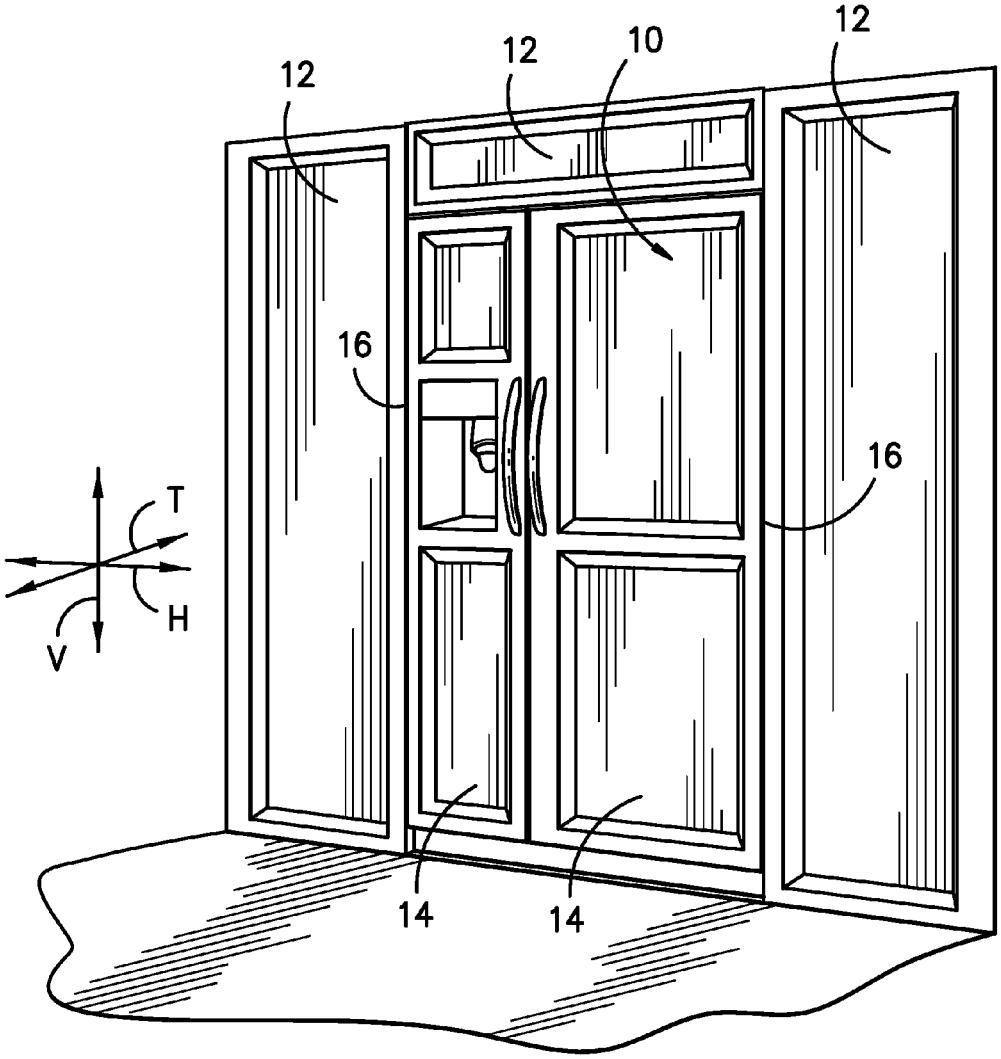
FIG. 1 is a perspective view of a consumer appliance, in this case a refrigerator, integrated with a plurality of cabinets in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a consumer appliance 10, in this embodiment in the form of a refrigerator, which may incorporate one or more assembly kits in accordance with embodiments of the present disclosure. It should be appreciated that the term "consumer appliance" or "appliance" are used in a generic sense herein to encompass any manner of household appliance having one or more manually operated doors that provide access to internal compartments. Conventional consumer appliances include, for example, refrigerators, freezers, ovens, washing machines, dryers, ranges, and so forth. For illustrative purposes, the present invention is described herein as a refrigerator embodiment of a consumer appliance 10. In this regard, the term "refrigerator" is also used in a generic sense herein to encompass any manner of refrigeration appliance, such as a freezer, refrigerator/freezer combination, and any style or model of conventional refrigerator. In the illustrated embodiment, refrigerator 10 is a flush-mounted refrigerator wherein the front of the refrigerator 10 lies essentially flush with the front of adjacent cabinetry 12, as is well understood by those skilled in the art.

As illustrated, an appliance 10 may include one or more door assemblies 14. In the embodiment shown, the refrigerator includes two door assemblies 14, each of which opens relative to a casing of the refrigerator along a hinge side 16 of that door assembly 14.

Figure 2:
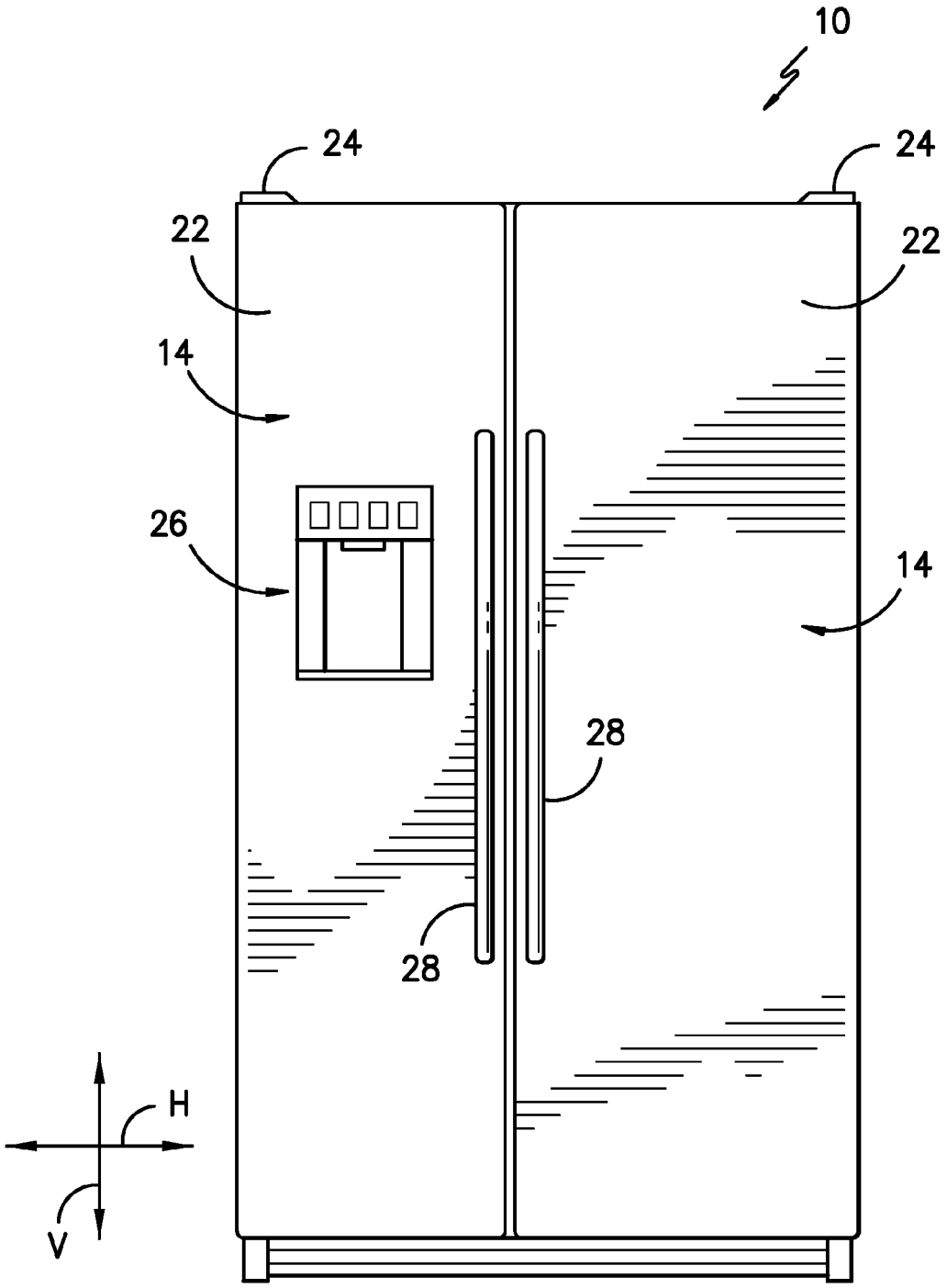
FIG. 2 is a front view of a refrigerator appliance, shown without decorative door panels for illustrative purposes, in accordance with one embodiment of the present disclosure.

Each door assembly 14 may include a decorative door panel 20 and an appliance door 22 (see FIG. 2). As discussed in detail herein, the decorative door panel 20 and appliance door 22 may be coupled together by one or more assembly kits. Each assembly kit may advantageously facilitate efficient and precise adjustment of the decorative door panel 20 relative to the appliance door 22, such as along at least two axes.

FIG. 2 is a front view of an appliance 10, in this case again a refrigerator. In this view, the decorative door panels 20 have been removed from the appliance doors 22 for illustrative purposes. It should be appreciated that the appliance of FIG. 2 is for illustrative purposes only and that the present invention is not limited to any particular type, style, or configuration of appliance.

The refrigerator may include a fresh food storage compartment and a freezer storage compartment, with the compartments arranged side-by-side and contained within an outer case. Appliance doors 22, in this case a freezer door and a fresh food door, close access openings to the freezer storage compartment and fresh food storage compartment. Each door 22 may be mounted by a top hinge 24 and a bottom hinge to rotate about its outer vertical edge between an open position and a closed position (illustrated).

The freezer storage compartment may include an automatic ice maker, and a dispenser 26 may be provided in the freezer door 22 such that ice and/or chilled water can be dispensed without opening the freezer door 22. The doors 22 may be opened by handles 28.

As illustrated in FIGS. 3 through 7, an appliance door 22 may include an inner surface 32, an outer surface 34 generally opposing the inner surface 32, and an edge surface 36 extending between and connecting the inner surface 32 and the outer surface 34. Similarly, a decorative door panel 20 may include an inner surface 42, an outer surface 44 generally opposing the inner surface 42, and an edge surface 46 extending between and connecting the inner surface 42 and the outer surface 44.

Further, each door assembly 14 may generally extend along and define a vertical axis V, a horizontal axis H, and a transverse axis T. The axes V, H, T may be defined generally orthogonal to each other, as illustrated.

Referring still to FIGS. 3 through 7, embodiments of a door assembly 14 for an appliance are illustrated. Each door assembly 14 includes an appliance door 22, a decorative door panel 20, and one or more assembly kits 50. Each assembly kit 50 may couple an appliance door 22 and a decorative door panel 20 together. Further, as stated, each assembly kit 50 may advantageously facilitate efficient and precise adjustment of the decorative door panel 20 relative to the appliance door 22, such as along at least two axes.

An assembly kit 50 in accordance with the present disclosure may include a first bracket 60 connectable to the appliance door 22. In exemplary embodiments as illustrated, the first bracket 60 is connectable to the edge surface 36 of the appliance door 22. The first bracket 60 may include, for example, a connection plate 62 for connection to the appliance door 22. Bore holes 64 may be defined in the connection plate 62, through which mechanical fasteners 66, such as screws, rivets, bolts, etc., may be extended to connect the connection plate 62 to the appliance door 22.

First bracket 60 may additionally include a spacer flange 68. The spacer flange 68 may extend generally perpendicular to the connection plate 62. The connection plate 62 and spacer flange 68 may be connected, integrally or otherwise.

An assembly kit 50 in accordance with the present disclosure may further include a second bracket 70 connectable to the decorative door panel 20. In exemplary embodiments as illustrated, the second bracket 70 is connectable to the inner surface 42 of the decorative door panel 20. The second bracket 70 may include, for example, a connection plate 72 for connection to the decorative door panel 20. Bore holes 74 may be defined in the connection plate 72, through which mechanical fasteners 76 may be extended to connect the connection plate 72 to the appliance door 22.

Second bracket 70 may additionally include a first spacer flange 78. The first spacer flange 78 may extend generally perpendicular to the connection plate 72. Second bracket 70 may further include a second spacer flange 80. The second spacer flange 80 may extend generally parallel to the connection plate 72. The first spacer flange 78 and second spacer flange 80 may be connected, integrally or otherwise, to the connection plate 72.

Figure 3:
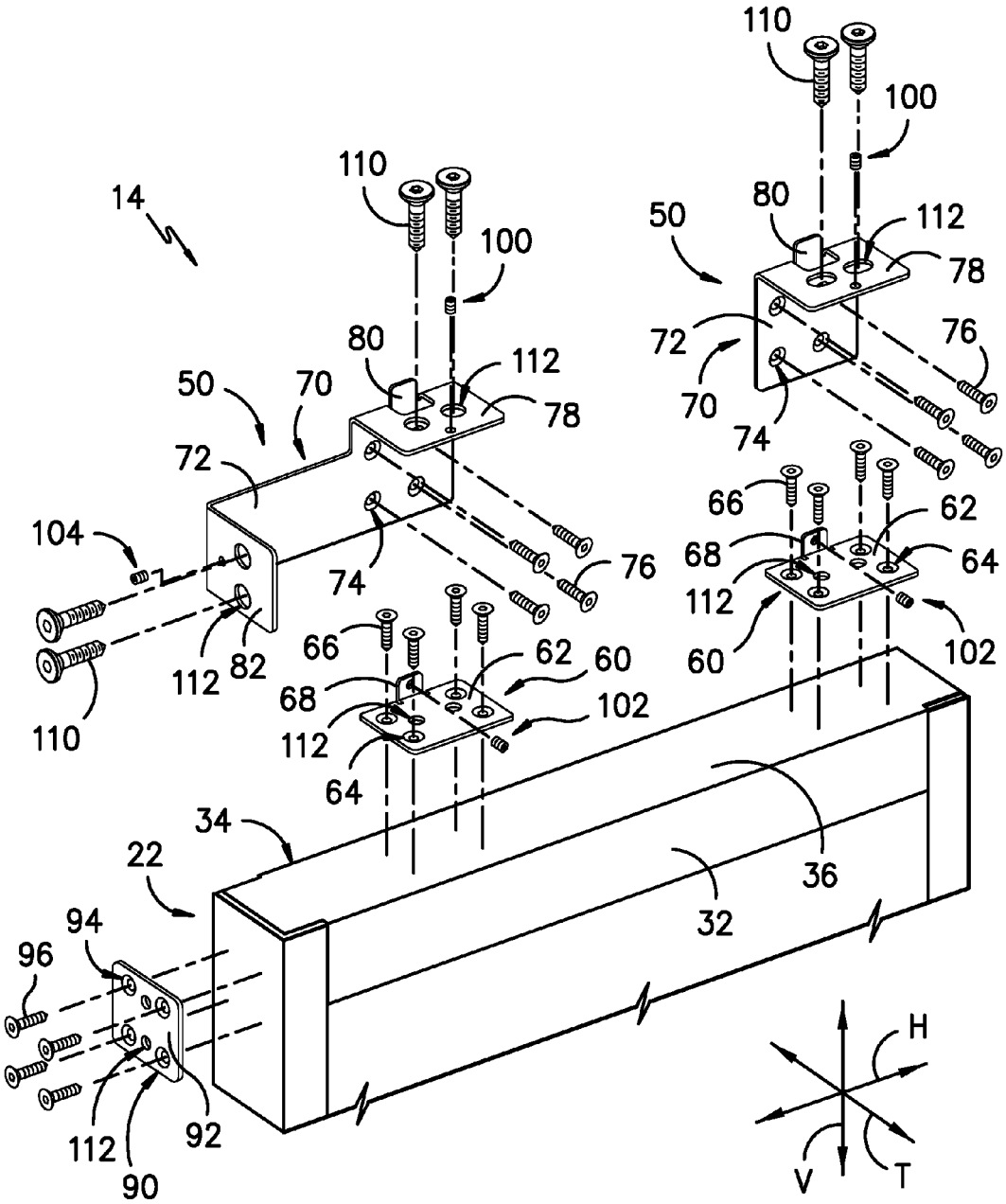
FIG. 3 is a perspective exploded view of various components of a plurality of assembly kits and an appliance door in accordance with one embodiment of the present disclosure.
Figure 4:
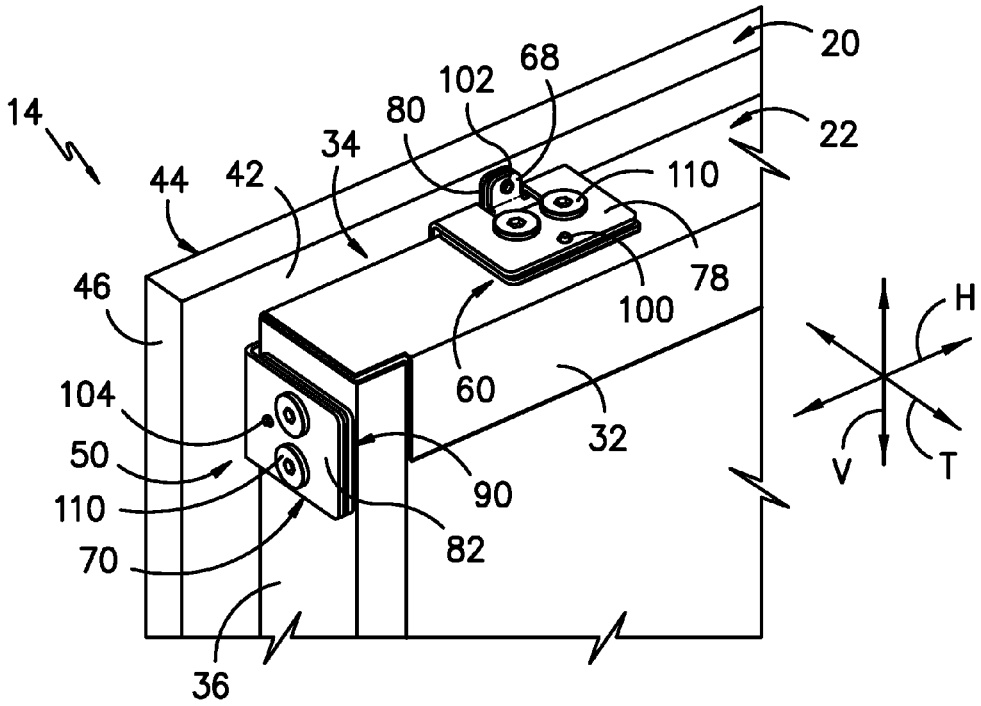
FIG. 4 is a top perspective view of an assembly kit coupling an appliance door and a decorative door panel together in accordance with one embodiment of the present disclosure.
Figure 5:
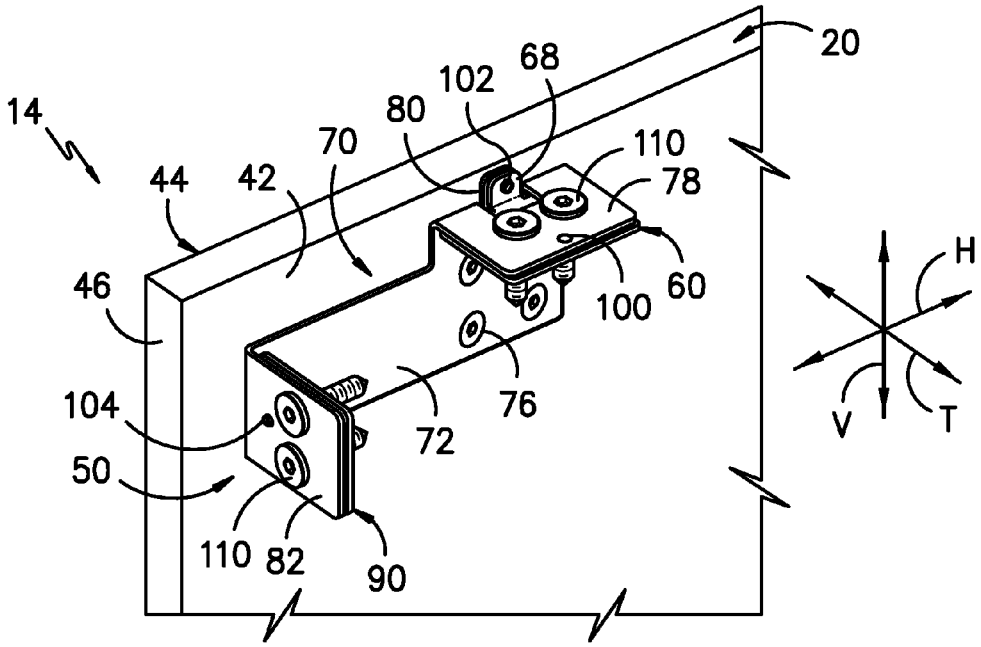
FIG. 5 illustrates the door assembly of FIG. 4 without the appliance door for illustrative purposes.
Figure 6:
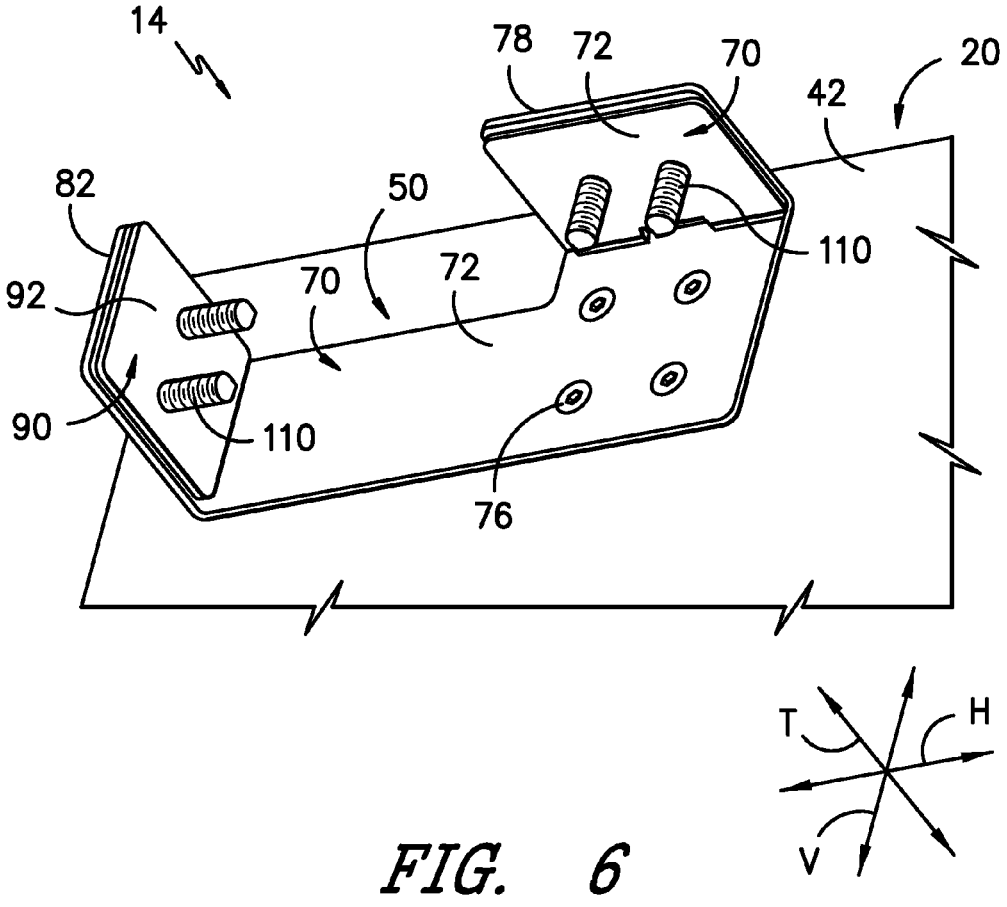
FIG. 6 is a bottom perspective view the door assembly of FIG. 4 without the appliance door for illustrative purposes.
Figure 7:
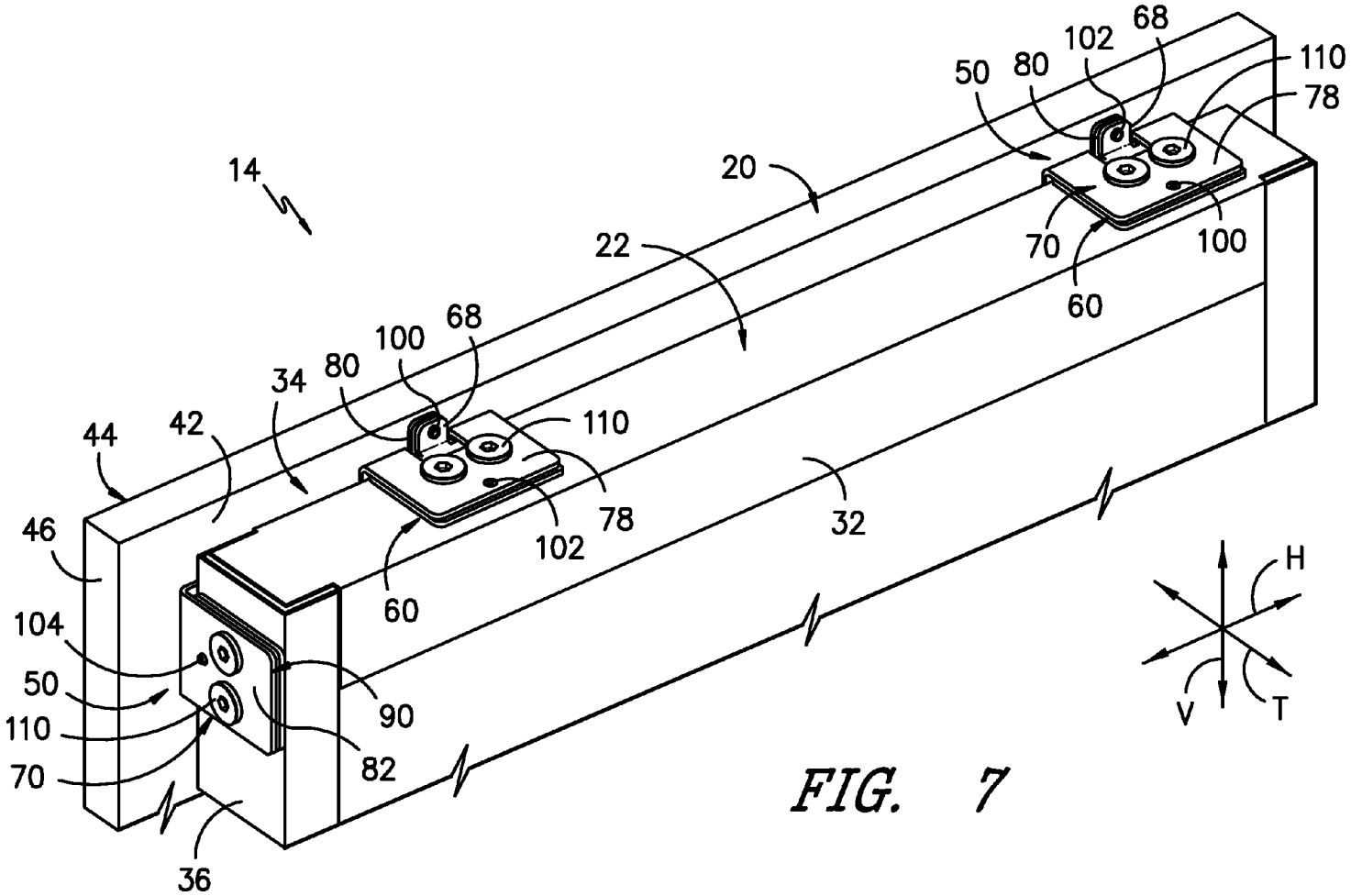
FIG. 7 is a perspective view of a plurality of assembly kits coupling an appliance door and a decorative door panel together in accordance with one embodiment of the present disclosure.

In some embodiments, as illustrated in FIGS. 3 and 7, an assembly kit 50 in accordance with the present disclosure may facilitate adjustment of the decorative door panel 20 along two axes relative to the appliance door 22. In these embodiments, the only brackets required are the first and second brackets 60, 70. Such assembly kits 50 may be utilized, for example, adjacent to the hinge side 16 of an appliance door 22. In other embodiments, as illustrated in FIGS. 3 through 7, an assembly kit 50 in accordance with the present disclosure may facilitate adjustment of the decorative door panel 20 along three axes relative to the appliance door 22. Such assembly kits 50 may he utilized, for example, adjacent the side of an appliance door that is opposite of the hinge side 16. In these embodiments, an assembly kit 50 may further include a third bracket 90.

Third bracket 90 may be connectable to the appliance door 22. In exemplary embodiments as illustrated, the third bracket 90 is connectable to the edge surface 36 of the appliance door 22, such as in an orientation perpendicular to that of the first bracket 60. The third bracket 90 may include, for example, a connection plate 92 for connection to the appliance door 22. Bore holes 94 may be defined in the connection plate 92, through which mechanical fasteners 96, such as screws, rivets, bolts, etc., may be extended to connect the connection plate 92 to the appliance door 22.

Further, the second bracket 70, in particular in embodiments in which a third bracket 90 is utilized, may include a third spacer flange 82. The third spacer flange 82 may extend generally perpendicular to the connection plate 72 and the first spacer flange 78. The third spacer flange 82 may be connected, integrally or otherwise, to the connection plate 72.

As shown, the first bracket 60 and optional third bracket 90 may thus be connected to the appliance door 22, and the second bracket 70 may thus be connected to the decorative door panel 20. As further illustrated in FIGS. 3 through 7, various movable spacers may be included in an assembly kit 50. The spacers may be positionable between the brackets and movable to adjust gaps between the brackets, thus resulting in adjustment of the decorative door panel 20 along at least two axes.

For example and as shown, assembly kit 50 may include a first spacer 100. The first spacer 100 may be positionable between the first bracket 60 and the second bracket 70, and may further be movable to adjust a gap between the first bracket 60 and the second bracket 70 along a first axis, such as along the vertical axis V as illustrated. For example, as illustrated, the first spacer 100 may be positionable between the connection plate 62 and the first spacer flange 78.

In exemplary embodiments as illustrated, the first spacer 100 may be a first set screw. In these embodiments, for example, the first spacer 100 may be threadably movable through the second bracket 70, such as through the first spacer flange 78 thereof. The first spacer 100 may further contact and press against the first bracket 60, such as the connection plate 62 thereof, to provide a gap between the first bracket 60 and second bracket 70 along a first axis. In alternative embodiments, the first spacer 100 may, for example, be a shim or another component for providing an adjustable gap between the first bracket 60 and second bracket 70.

Further, assembly kit 50 may include a second spacer 102. The second spacer 102 may be positionable between the first bracket 60 and the second bracket 70, and may further be movable to adjust a gap between the first bracket 60 and the second bracket 70 along a second axis different from the first axis, such as along the transverse axis T as illustrated. For example, as illustrated, the second spacer 102 may be positionable between the spacer flange 68 and the second spacer flange 80.

In exemplary embodiments as illustrated, the second spacer 102 may be a second set screw. In these embodiments, for example, the second spacer 102 may be threadably movable through the first bracket 60, such as through the spacer flange 68 thereof. The second spacer 102 may further contact and press against the second bracket 70, such as the second spacer flange 80 thereof, to provide a gap between the first bracket 60 and second bracket 70 along a second axis. In alternative embodiments, the second spacer 102 may, for example, be a shim or another component for providing an adjustable gap between the first bracket 60 and second bracket 70.

Still further, assembly kit 50 may include a third spacer 104. The third spacer 104 may be positionable between the third bracket 90 and the second bracket 70, and may further be movable to adjust a gap between the third bracket 90 and the second bracket 70 along a third axis different from the first axis and second axis, such as along the vertical axis H as illustrated. For example, as illustrated, the third spacer 104 may be positionable between the connection plate 92 and the third spacer flange 82.

In exemplary embodiments as illustrated, the third spacer 104 may be a third set screw. In these embodiments, for example, the third spacer 104 may be threadably movable through the second bracket 70, such as through the third spacer flange 82 thereof The third spacer 104 may further contact and press against the third bracket 90, such as the connection plate 92 thereof, to provide a gap between the third bracket 90 and second bracket 70 along a third axis. In alternative embodiments, the third spacer 104 may, for example, be a shim or another component for providing an adjustable gap between the third bracket 90 and second bracket 70.

It should be noted that in exemplary embodiments, the axes, such as axes V, H and T, are generally orthogonal to each other. Accordingly, each of the first, second and third axes may be generally perpendicular to the other two axes.

Accordingly, first, second and optional third spacers 100, 102, 104 may be positioned between the various respective brackets as discussed above. Movement of the spacers 100, 102, 104 may adjust gaps between the brackets along various axes, which may advantageously facilitate efficient and precise adjustment of the decorative door panel 20 relative to the appliance door 22.

An assembly kit 50 may further include one or more fasteners 110. Fasteners 110 may be operable to couple the first bracket 60 and second bracket 70 together. Further, fasteners 110 may be operable to couple the second bracket 70 and third bracket 90 together. Such coupling may thus couple the appliance door 22 and decorative door panel 20 together to form a door assembly 14. Fasteners 110 are generally mechanical fasteners, such as screws as illustrated. In exemplary embodiments, screws having oversized washer-type flat heads may be utilized.

Fasteners 110 may extend through fastener bore holes 112 defined in the respective brackets 60, 70, 90 to couple these brackets together. For example, as illustrated, fastener bore holes 112 may be defined in the first bracket 60 and second bracket 70, such as in the connection plate 62 and first spacer flange 78 thereof Fastener bore holes 112 may additionally be defined in the third bracket 90 and second bracket 70, such as in the connection plate 92 and third spacer flange 82 thereof Fasteners 110 may extend through these bore holes 112 to couple the respective brackets together, as illustrated. Notably, when the fasteners 110 couple the brackets together, thus coupling the appliance door 22 and decorative door panel 20 together to form a door assembly 14, the spacers 100, 102, 104 prevent the fasteners 100 from closing the gaps between the brackets, such that the two- or three-axis adjustment of the decorative door panel 20 is advantageously maintained.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An assembly kit for coupling an appliance door and a decorative door panel together, the assembly kit comprising:

a first bracket connectable to the appliance door;

a second bracket connectable to the decorative door panel;

a first spacer positionable between the first bracket and the second bracket, the first spacer rotatable to adjust a first gap between the first bracket and the second bracket along a first axis;

a second spacer positionable between the first bracket and the second bracket, the second spacer rotatable to adjust a second gap between the first bracket and the second bracket along a second axis generally orthogonal to the first axis;

a fastener coupling the first bracket and the second bracket together;

a third bracket connectable to the appliance door; and a third spacer positionable between the third bracket and the second bracket, the third spacer rotatable to adjust a third gap between the third bracket and the second bracket along a third axis generally orthogonal to the first axis and the second axis, wherein the third spacer is threadably rotatable through the second bracket.

2. The assembly kit of claim 1, wherein the third spacer is a third set screw.

3. The assembly kit of claim 1, wherein the first spacer is a first set screw and the second spacer is a second set screw.

4. The assembly kit of claim 3, wherein the first set screw is threadably movable through the second bracket.

5. The assembly kit of claim 3, wherein the second set screw is threadably movable through the first bracket.

6. The assembly kit of claim 1, wherein the first bracket is connectable to an edge surface of the appliance door and the second bracket is connectable to an inner surface of the decorative door panel.

7. The assembly kit of claim 1, wherein the second bracket comprises a connection plate for connection to the decorative door panel, a first spacer flange extending generally perpendicular to the connection plate, and a second spacer flange extending generally parallel to the connection plate.

8. The assembly kit of claim 7, wherein the second bracket further comprises a third spacer flange extending generally perpendicular to the connection plate.

9. A door assembly for an appliance, the door assembly comprising:

an appliance door, the appliance door comprising an inner surface, an outer surface, and an edge surface extending between the inner surface and the outer surface;

a decorative door panel, the decorative door panel comprising an inner surface, an outer surface, and an edge surface extending between the inner surface of the door panel and the outer surface of the door panel; and an assembly kit coupling the appliance door and the decorative door panel together, the assembly kit comprising:

a first bracket connected to the appliance door;

a second bracket connected to the decorative door panel;

a first spacer positioned between the first bracket and the second bracket, the first spacer rotatable to adjust a first gap between the first bracket and the second bracket along a first axis;

a second spacer positioned between the first bracket and the second bracket, the second spacer rotatable to adjust a second gap between the first bracket and the second bracket along a second axis generally orthogonal to the first axis;

a fastener coupling the first bracket and the second bracket together;

a third bracket connected to the appliance door; and a third spacer positioned between the third bracket and the second bracket, the third spacer rotatable to adjust a third gap between the third bracket and the second bracket along a third axis generally orthogonal to the first axis and the second axis wherein the third spacer is threadably rotatable through the second bracket.

10. The door assembly of claim 9, wherein the third spacer is a third set screw.

11. The door assembly claim 9, wherein the first spacer is a first set screw and the second spacer is a second set screw.

12. The door assembly of claim 11, wherein the second set screw is threadably movable through the first bracket.

13. The door assembly of claim 9, wherein the first bracket is connected to the edge surface of the appliance door and the second bracket is connected to the inner surface of the decorative door panel.

* * * * *